United States Patent [19]

Marshall

[11] 4,201,012

[45] May 6, 1980

[54] REMOTE CONTROL VEHICLE

[76] Inventor: Harry L. Marshall, 14330 Zubrick Rd., Roanoke, Ind. 46783

[21] Appl. No.: 895,859

[22] Filed: Apr. 13, 1978

[51] Int. Cl.[2] ..... A63H 30/00

[52] U.S. Cl. ..... 46/256; 273/312

[58] Field of Search ..... 273/101.1; 180/98; 46/256, 262

[56] References Cited

U.S. PATENT DOCUMENTS

| | | | |
|---|---|---|---|
| 2,838,876 | 6/1958 | Smith, Jr. | 46/256 |
| 2,921,408 | 1/1960 | Leblic | 46/256 |
| 3,119,201 | 1/1964 | Brown et al. | 46/256 |
| 3,308,577 | 3/1967 | Holt | 46/256 |
| 3,314,189 | 4/1967 | Carroll | 46/256 |
| 3,406,481 | 10/1968 | Tachi | 46/256 |
| 3,724,854 | 4/1973 | Brooks et al. | 46/256 |
| 3,786,597 | 1/1974 | Sano | 46/262 |
| 3,849,931 | 11/1974 | Gulley, Jr. | 46/256 |
| 3,909,276 | 9/1975 | Wolf | 46/262 |
| 3,935,922 | 2/1976 | Cooper et al. | 180/98 |
| 4,054,290 | 10/1977 | Villa | 273/101.1 |

FOREIGN PATENT DOCUMENTS

| | | | |
|---|---|---|---|
| 1208391 | 1/1966 | Fed. Rep. of Germany | 180/98 |

*Primary Examiner*—Louis G. Mancene
*Assistant Examiner*—Paul J. Hirsch
*Attorney, Agent, or Firm*—Richard T. Seeger

[57] ABSTRACT

A vehicle having four LDRs (light dependent resistors) on the upper surface thereof has a first motor for driving the vehicle in a forward or reverse direction and a second motor for turning the vehicle in a rightward or leftward direction. Selective light illumination on LDRs causes the vehicle to be propelled in a forward or reverse direction or to turn in a right or left direction. A selected LDR pair may be illuminated simultaneously to cause the vehicle to move forwardly and rightwardly; to move forwardly and leftwardly; to move rearwardly and rightwardly; and to move rearwardly and leftwardly. The LDRs may all be sensitive to the same radiation frequency range or may be responsive only to radiation frequencies in mutually exclusive ranges. A manually operated radiation frequency generator is used to illuminate the LDRs and control the car direction movement. The generator may have a single band of frequency ranges or may have specific limited and mutually exclusive radiation frequency bands. Each vehicle may have all of its LDRs sensitive to a given frequency range which range is mutually exclusive from the ranges of other vehicles.

10 Claims, 11 Drawing Figures

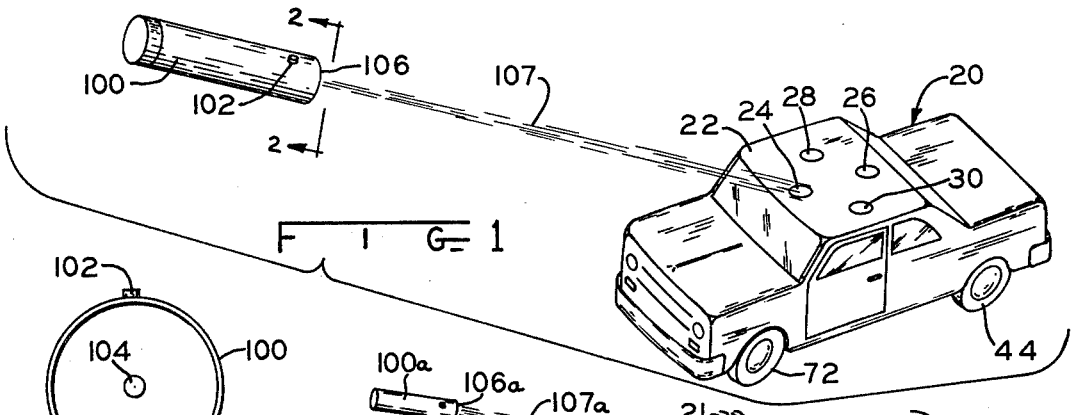
FIG. 1
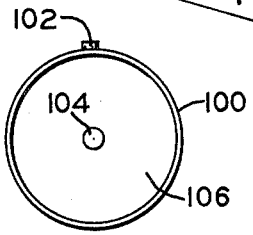
FIG. 2
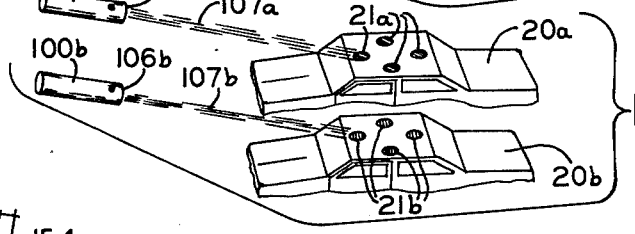
FIG. 1a
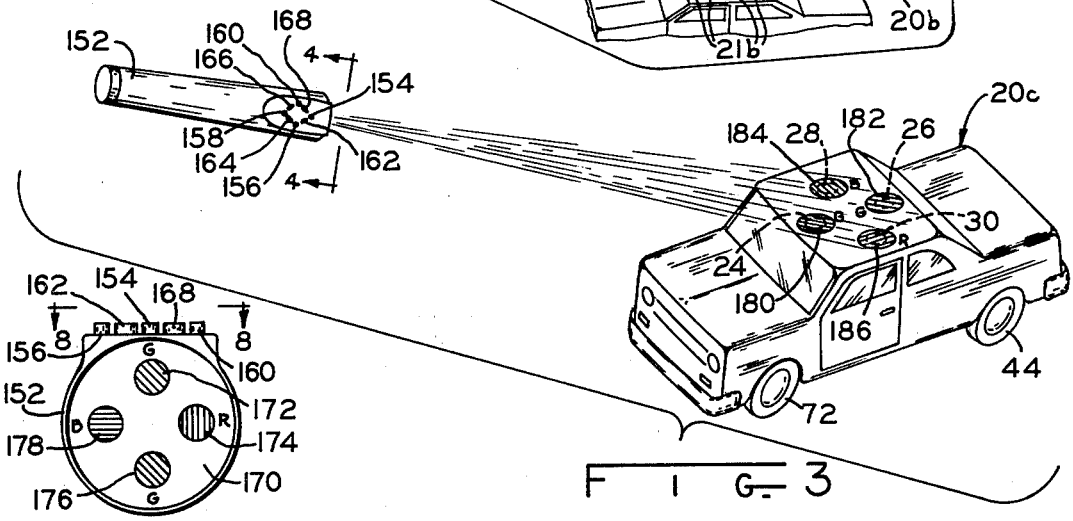
FIG. 3
FIG. 4
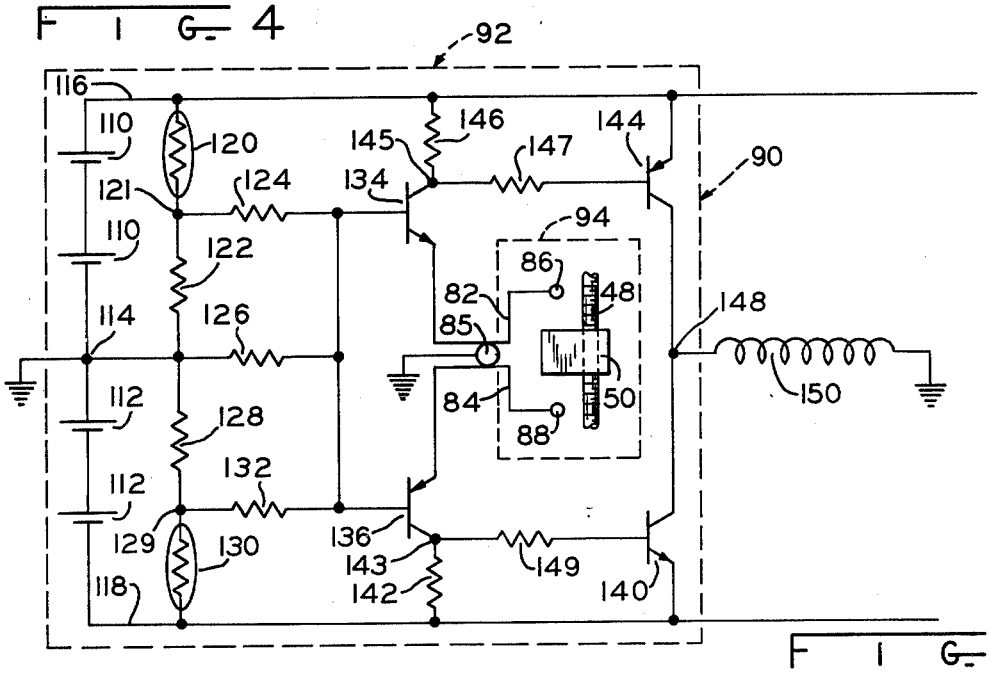
FIG. 5

REMOTE CONTROL VEHICLE

BACKGROUND OF THE INVENTION

1. Field of the Invention

This invention is in the field of remote control vehicles and more particularly to toy vehicles which are responsive to light energy to provide directional movement.

2. Description of the Prior Art

Remote control toy vehicles of the kind responsive to light energy for providing directional movement are well known in the art. Generally, these vehicles have a plurality of photocells for converting light energy to electrical energy which in turn are used to directionally drive the vehicle. However, the maneuverability and control of such devices have been limited and as a result they have never found wide usage with the consuming public.

SUMMARY OF THE INVENTON

A toy vehicle body has rotatably mounted to the underside thereof at a rearward position a pair of spaced wheels which are driven by a first motor. A pair of LDRs are coupled to the motor coil winding such that light illumination on one of the LDRs will cause current flow in one direction in the winding to cause the motor shaft to rotate the wheels in one direction and light illumination on the other LDR will cause current flow in the motor coil winding in the opposite direction to cause the motor shaft to rotate in the opposite direction thus rotating the wheels in the opposite direction. Therefore, light illumination on one LDR will cause the vehicle to go forward and light illumination on the other LDR will cause the vehicle to go in a reverse direction.

A second pair of spaced wheels are mounted forwardly of the underside of the vehicle body and are mounted for rotation about the respective wheel axes. Also, each of the wheels are mounted to turn about a vertical axis and are connected by a steering or tie rod to cause the wheels to steer in unison. A second motor is connected to the steering rod to move it in one direction for rightward turning and in the opposite direction for leftward turning. A second pair of LDRs are mounted to the vehicle upper surface and illumination of one of the LDRs will cause current to flow in the second motor coil winding in one direction to cause the motor shaft to rotate in one direction thus moving the rod to steer the front wheels in a rightward direction and light illumination on the second LDR in the pair will cause current flow in the second motor coil winding in the opposite direction to cause the motor shaft to rotate in the opposite direction thus moving the rod in the opposite direction to cause the front wheels to steer in the leftward direction. Limit switches are placed in the path of the rod movement to de-energize the second motor after the front wheels have been turned in a maximum rightward or leftward steering direction. Alternatively, a slip clutch may be utilized between the second motor and the rod.

The LDRs may be responsive to the same range of light energy frequency or may be responsive to mutually exclusive frequency ranges. By placing colored filters over the LDRs, the LDRs will be responsive only to that light frequency range passing through the filters. By providing a hand held manipulable illuminator having light frequency sources corresponding to the filters, the LDRs may be easily individually energized to increase and improve the control and maneuverability of the vehicle. The LDRs may be operated in pairs to vary the turning arc of the vehicle thus further increasing its maneuverability and making it adaptable for usage on a racing track with other vehicles on the track. Each vehicle can be responsive to light illumination in mutually exclusive ranges so that an illuminator for one vehicle would not affect the control of another vehicle.

The illuminator may generate a single frequency range, such as that of an incandescent lamp, and would thus require only one switch control. The illumination frequency range may be limited to correspond to LDR filters for a particular vehicle, with each vehicle having a different mutually exclusive frequency range from other vehicles. Alternatively, each illuminator may emit a multiplicity of separate frequency ranges, which may be mutually exclusive, each corresponding to a corresponding LDR filter on an individual vehicle, and have four separate switch controls for energizing the different ranges. Advantageously, the four switch controls may be operated separately or in pairs to increase the control and maneuverability of the vehicle. The frequency ranges may include infrared and ultraviolet frequencies.

It is therefore an object of this invention to provide a remote controlled, radiation actuated drive system for a vehicle that has improved maneuverability and control.

It is an object to provide in a device according to the aforementioned object controls for moving the vehicle in forward, reverse, rightward, and leftward directions.

A still further object of this invention is to provide in a device of the foregoing objects an illumination system which will permit racing of several vehicles on a track and having mutually exclusive frequency ranges for control of the vehicles.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 1 is a view in perspective of a first preferred embodiment of this invention showing a vehicle and an illuminator therefor;

FIG. 1*a* is a partial view in perspective of another embodiment wherein two vehicles, each having LDR filters and each having an illuminator with a frequency range corresponding to the range of the filters, for its vehicle;

FIG. 2 is an enlarged view taken along 2—2 of the illuminator in FIG. 1;

FIG. 3 is a view in perspective of another embodiment of this invention wherein the vehicle has LDR filters and the illuminator has separate frequency ranges corresponding to the filters;

FIG. 4 is an enlarged view taken along 4—4 of the illuminator of FIG. 3;

FIG. 5 is a control circuit diagram, partially diagrammatic for operating motors in the embodiments in FIGS. 1 and 3;

DESCRIPTION OF THE PREFERRED EMBODIMENT

Figure 6:
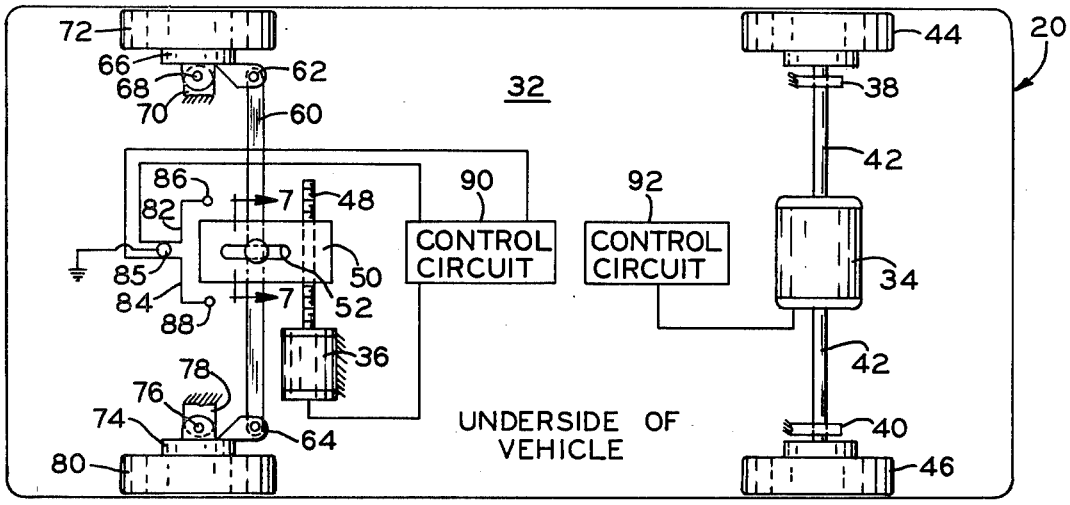
FIG. 6 is an enlarged bottom plan view, partially diagrammatic, of the vehicle shown in FIGS. 1 and 3.

Referring to the drawings, FIG. 1, a toy vehicle 20, which is shown in the configuration of an automobile, but which may assume any other vehicle configuration, has an upper surface 22 wherein there are placed a first LDR pair having LDRs 24, 26 and a second LDR pair having LDRs 28, 30. The LDRs may also be placed on other vehicle surfaces. Referring to FIG. 6, the underside 32 of vehicle 20 has fixed thereto motors 34, 36. Affixed to surface 32 near the rearward portion thereof are brackets 38, 40 which have openings therein for rotatably supporting shaft 42 of motor 34. Rear wheels 44, 46 are affixed to opposite ends of shaft 42 and are driven thereby. Motor 36 rotates a threaded shaft 48 which is threadedly engaged with block 50 to move block 50 longitudinally of shaft 48 upon rotation thereof, the direction of movement depending on the direction of rotation. Block 50 (FIG. 7) has a slot 52 for receiving a pin 54 having head 56 riding on the outer surface of block 50. Pin 54 is affixed at the end opposite to head 56 to a steering or tie rod 60 which is pivotably connected at one end to bracket 62 and at the other end to bracket 64. Bracket 62 is affixed to front wheel mount 66 which is pivotably supported about vertical axis 68 to bracket 70, which is fixed to underside 32. Front wheel 72 is rotatably supported on mount 66. Bracket 64 is affixed to wheel mount 74 which is rotatably supported about vertical axis 76 relative to bracket 78, which is affixed to underside 32. Wheel 80 is rotatably supported by mount 74. It is seen that depending on the direction of rotation of shaft 48, block 50 will be moved upwardly or downwardly, as viewed in FIG. 6, which in turn will move tie rod 60 upwardly or downwardly to steer wheels 72, 80 in a rightwardly or leftwardly direction respectively.

Resilient conductive limit switch arms 82, 84 have insulative switch buttons 86, 88 at their respective ends, which are registrable with block 50 and resiliently displaceable by block 50 in its uppermost and lowermost travel respectively, as viewed in FIG. 6. Arms 82, 84 are resiliently urged against ground terminal 85 in control circuit 90, later described, as is motor 36. The electrical coupling between arms 82, 84 and terminal 85 is broken when block 50 displaces buttons 86, 88, respectively. Circuit 90 is conveniently contained within vehicle 20 and is also electrically coupled to LDRs 28, 30 (FIG. 1). Control circuit 92 is electrically coupled to motor 34, and is conveniently contained within vehicle 20, with circuit 92 also being electrically coupled to LDRs 24, 26 (FIG. 1).

Illuminator 100 (FIG. 1), which may house flashlight batteries and be of a flashlight size, is dimensioned for manual manipulation and has a control button 102 for energizing a light source 104, (FIG. 2) which may be an incandescent bulb, the radiation of which is collimated by lens 106, which lenses are well known in the art and commercially available.

FIG. 5 is a schematic diagram of control circit 90, the functions of which may be obtained by equivalent circuits such as may be incorporated in an integrated circuit. Circuit 90 is identical to control circuit 92 with the deletion of those elements shown in dashed box 94, and both emitters of transistors 134, 136 are connected directly and permanently connected to ground. Batteries 110, 112, each of which may comprise a pair of batteries commercially available, and may be rechargeable are connected at juncture 114 which is grounded. Batteries 110, 112 are so placed as to put a plus 3 volts on line 116 and a minus 3 volts on line 118. LDR 120 has one terminal connected to line 116 and the other terminal connected at junction 121 to first terminals of resistances 122 and 124. The other terminal of resistance 122 is connected to first terminals of resistances 126, 128 and ground, with the other terminal of resistance 128 connected at junction 129 to first terminals of LDR 130 and resistance 132. The other terminal of LDR 130 is connected to line 118. Resistance 124 has its other terminal connected to the base of NPN transistor 134 and the base of PNP transistor 136 and to the other terminals of resistances 126 and 132.

Emitters of transistors 134 and 136 are in disengageable electrical contact with terminal 85 which is grounded. The collector of transistor 136 is connected at junction 143 to first terminals of resistors 142, 149. The other terminal of resistor 149 is connected to the base of an NPN transistor 140. The other terminal of resistor 142 is connected to line 118. The collector of transistor 134 is connected at junction 145 to first terminals of resistors 146, 147. The other terminal of resistor 147 is connected to the base of PNP transistor 144 and the other terminal of resistor 146 is connected to line 116. The collectors of transistors 140, 144 are connected to junction 148 which is connected to one terminal of motor coil 150, the other terminal of motor coil 150 being grounded. The emitters of transistors 140, 144 are connected respectively to lines 118 and 116.

As mentioned, for circuit 92, circuit 94 is added. As block 50 moves rightwardly and leftwardly on screw shaft 48, as previously explained, it will displace buttons 86, 88, respectively, to resiliently displace open the electrical contact between spring arms 82, 84, respectively, with terminal 85 thus deenergizing motor coil 150.

In operation of the embodiment shown in FIG. 1, illuminator 100 is directed so that a beam 107 from lens 106 impinges on one of LDRs 24, 26, 28 and 30. Assuming that it is desired to steer front wheels 72, 80 to the right, beam 107 will be directed to impinge upon LDR 28, which in circuit 92, is LDR 120. LDR 120 is a light dependent resistor which lowers in resistance upon incident light thus causing junction 121 to rise in potential raising the voltage at the base of transistor 134 to turn it on. As is understood in art, "on" may mean the transistor is fully saturated, or partially saturated as is desired. Transistor 134 normally nonconducting since during balanced conditions when LDRs 120 and 130 are equally illuminated, is at ground potential. When 134 starts conducting, the potential at junction 145 lowers, turning on transistor 144 causing current flow in motor coil 150 in a rightward direction as viewed in FIG. 5. Assuming correct wiring connections and winding directions, motor 36 is caused to rotate shaft 48 in a direction to move block 50 leftwardly which would be upwardly as viewed in FIG. 6. This movement of block 50 will continue until either beam 107 is removed from LDR 28 or until block 50 displaces button 86 breaking the connection between the emitter of transistor 134 and terminal 85, turning "off" transistors 134 and 144, and removing current from motor coil 150. This defines the maximum steering angle of wheels 72, 80 in the rightward direction.

Similarly, if the operator wanted to turn wheels 72, 80 in a leftward direction, he would cause beam 107 to impinge upon LDR 30, which corresponds to LDR 130 in FIG. 5, lowering its resistance, lowering, or making more negative, the potential at junction 129 and the base of normally nonconducting transistor 136 to turn transistor 136 "on," raising the potential at junction 143 to turn transistor 140 "on," causing current flow in a leftward direction, as viewed in FIG. 5, through the motor winding of motor 36, which is winding 150 in the diagram of FIG. 5, causing motor 36 to rotate shaft 48 in a direction to move block 50 rightwardly, which is downwardly as viewed in FIG. 6. This moves rod 60 rightwardly causing wheels 72, 80 to steer leftwardly about axes 68, 76, respectively. Block 50 will continue its rightward movement until either beam 107 is removed from LDR 30 or until block 50 displaces button 88 breaking the connection between the emitter of transistor 136 and terminal 85, turning "off" transistors 136, 140 and removing current from coil 150, to define the maximum leftward steering angle of wheels 72, 80.

Assuming it is desired to move vehicle 20 forwardly, illuminator 100 is directed so that beam 107 impinges on LDR 24, which would be LDR 120 in circuit 90 in the diagram of FIG. 5, lowering its resistance, raising the potential at junction 121, and base of transistor 134 to turn that normally nonconducting transistor "on," lowering the potential at junction 145 and the base of transistor 144, causing that transistor to conduct causing a current flow in a first direction through the winding of motor 34, which would be winding 150 in the diagram of FIG. 5. This rotates shaft 42 causing wheels 44, 46 to rotate in a counterclockwise direction, when viewed from the left side, moving vehicle 20 forwardly. Assuming that it is desired to cause vehicle 20 to move in a rearwardly direction, illuminator 100 is directed by the user until beam 107 impinges on LDR 26, which corresponds to LDR 130 in the diagram of FIG. 5 lowering the potential at junction 129 and the base of 136 turning that normally nonconducting transistor "on," raising the potential at junction 143 and the base of transistor 140, turning that transistor "on" to cause a current flow in a second direction through the winding of motor 34, which corresponds to winding 150 in FIG. 5. Motor 34 will then rotate shaft 42 in a direction to move wheels 44, 46 in a clockwise direction when viewed from the left side driving vehicle 20 rearwardly. The turning arc of vehicle 20 can be controlled by proportionally illuminating LDRs 24 and 28, with the arc radius being larger if LDR 24 receives more illumination than LDR 28 and the arc radius being smaller if LDR 28 receives more illumination. Similarly, vehicle 20 can be caused to move in a controllable forward leftward arc by coordinating illumination of LDRs 24 and 30, with the arc radius being greater when LDR 24 receives more illumination and the arc radius being smaller when LDR 30 receives more illumination. In similar manner, a vehicle can be caused to move rearwardly in an arc by coordinating illumination of LDRs 26 and 28 or LDRs 26 and 30.

Referring to FIG. 1*a*, a further embodiment is shown wherein vehicles 20*a*, 20*b* respectively, are operated by illuminators 100*a*, 100*b*. Vehicle 20*a* has LDR filters 21*a* which, for any one vehicle, are all of the same frequency range which may be a red, blue, or green color, and in the embodiment shown are green, placed over each LDRs 24, 26, 28, and 30, not shown but are understood to be under the filters 21*a* and positioned as in the embodiment of FIG. 1. Illuminator 100*a* has an actuator button 102*a* and a lens 106*a* which is tinted or otherwise provided with a filtering member which will provide beam 107*a* with a frequency that will be substantially coextensive or within the frequency range passed by the filters 21*a*, and which is green in the embodiment illustrated. Illuminator 100*b* and filters 21*b* are frequency related to the color blue. Thus, by providing each of several vehicles 20*a*, 20*b* with filters 21*a*, 21*b*, respectively that has a mutually exclusive frequency range different from the filter 21 for each of the other vehicles, respectively, in combination with an illuminator 100*a*, 100*b* having lens 106*a*, 106*b* respectively that will provide a frequency range which is coextensive or within the frequency range of the filters for a corresponding vehicle, then when several vehicles are being operated on the same track, inadvertent, or intentional, operation of a vehicle other than the one associated with a particular illuminator 100*a* will be prevented. Thus, a separate illuminator 100 would be provided for each of several vehicles 20 and would be capable of operating only a corresponding one of the several vehicles. The filters on any vehicle may be changeable from one frequency range to another. Each of the illuminators 100 would generate a beam 107 having a frequency range different from that of the other illuminators.

Figure 7:
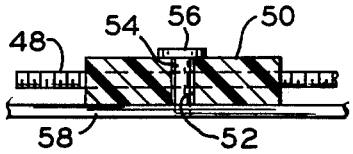
FIG. 7 is an enlarged partial sectional view taken at 7—7 of FIG. 6.

Referring now to FIGS. 3, 4, 8 and 9, a further embodiment having different colored filters over the LDRs for more selective control will be described. For this embodiment, the underside 32 mechanism as shown in FIGS. 6 and 7 and the control circuits 90, 92 as shown in FIG. 5 will be identical to that for the embodiment shown and described for FIG. 1. The illuminator 152, which may house flashlight batteries and may be of a flashlight size, has buttons 154, 156, 158, 160 which are depressed respectively for moving vehicle 20*c* forwardly, rightwardly, rearwardly and leftwardly. Where the same frequency range is used for two different directions, only three buttons would be necessary. Illuminator 152 also has buttons 162, which, as will become apparent, actuates both buttons 154 and 156, button 164, which actuates both buttons 156 and 158, button 166 which actuates both buttons 158 and 160, and button 168 which actuates both buttons 154 and 160. Illuminator 152 has a lens 170, FIG. 4, attached at the forward end thereof and has four separate collimated light beams 172, 174, 176, 178 emanating therefrom. Beam 172 is green, 174 is red, 176 is green and 178 is blue. Corresponding filters 180, 186, 182 and 184 are placed over LDRs 24, 26, 28 and 30 so that green filter 180 is placed over LDR 24, green filter 182 is placed over LDR 26, blue filter 184 is placed over LDR 28, and red filter 186 is placed over LDR 30.

Circuitry, not shown, but conventional in the art, is placed in illuminator 152 so that button 154 actuates beam 172 and LDR 24; button 156 actuates beam 178 and LDR 28; button 158 actuates beam 176 and LDR 26; and button 160 actuates beam 174 and LDR 30. Thus, depressing button 154 will cause vehicle 20 to move forwardly when directed at LDR 24; depressing button 156 will cause the vehicle to steer rightwardly when impinging upon LDR 28; depressing button 158 will cause the vehicle to go in a reverse direction when directed at LDR 26; and depressing button 160, the vehicle will be steered leftwardly since LDR 30 will be energized. The radiation frequency ranges of beams 172, 174, and 178 are selected to be mutually exclusive so that only one LDR will be energized for one button depression even though more than one of the corresponding LDRs would be in a beam path. Beams 172 and 176 are both green and therefore either may be used to energize LDRs 24 and 26, both of which have green filters. It is noted that the illuminator 100 may also be used with the vehicle 20*a* in FIG. 3 since the frequency range of ray 107 may be selected to include all of the frequency ranges transmitted by filters 180, 182, 184 and 186.

Figure 8:
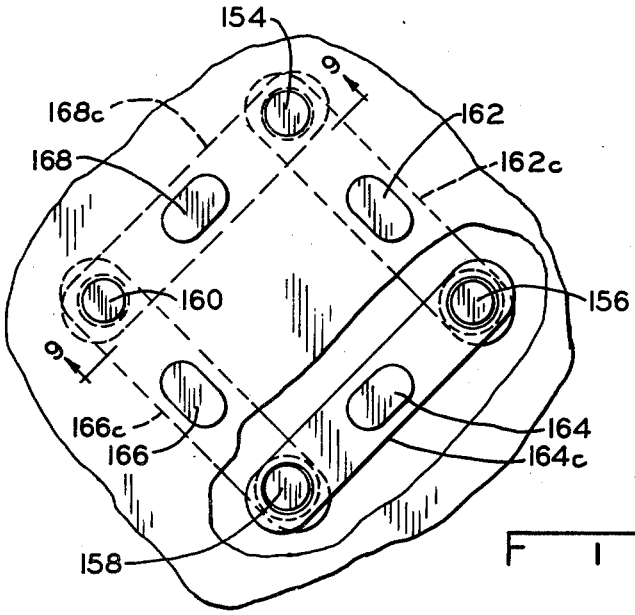
FIG. 8 is an enlarged partial plan view of the control switches taken from the direction of arrows 8 in FIG. 4.
Figure 9:
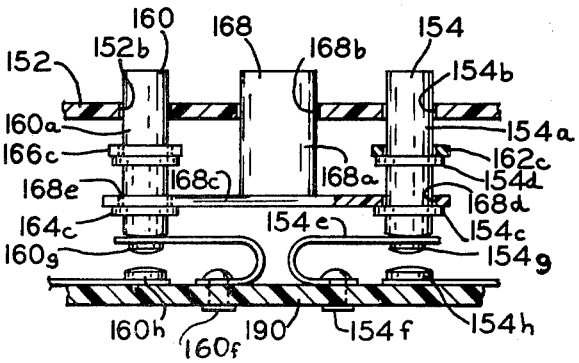
FIG. 9 is a partial section taken at 9—9 of FIG. 8.

Referring to FIGS. 8 and 9, a switching arrangement for illuminator 152 is shown wherein one button depression can simultaneously depress a predetermined pair of buttons 154, 156, 158 and 160. Each button 154, 156, 158 and 160 is of similar physical construction and only button 154 will be described. Button 154 has an elongate shank 154*a* which extends through opening 154*b* in housing wall of illuminator 152 and has an annular ridge 154*c* formed near the lower end thereof and a second ridge 154*d* longitudinally spaced upwardly from ridge 154*c*. The lower end of button 154 bears against a resilient arm 154*e* which is anchored at one end to rivet 154*f* to an insulative board 190 mounted in illuminator 152. A contact 154*g* is at the free end of arm 154*e* and bears against a conductive contact 154*h* affixed to board 190 when button 154 is depressed. Upon depression of button 154, contacts 154*g* and 154*h* electrically engage to complete a circuit, not shown, for energizing green beam 172.

Buttons 162, 164, 166 and 168 are similar in construction and only button 168 will be described. Button 168 has a shank 168*a* with an oval cross section which extends through opening 168*b* in the housing wall of illuminator 152. The lower end of shank 168*a* is affixed to a plate 168*c* which has a first opening 168*d* for receiving shank 154*a* and a second opening 168*e* for receiving shank 160*a*. The lower surface of plate 168*c* bears against ridge 154*c* and ridge 164*c* so that depression of button 168 will cause simultaneous depression of buttons 154 to close contacts 154*g*, 154*h* and 160 to close contacts 160*g*, 160*h*. Thus, depression of button 168 will energize green beam 172 and red beam 174, causing the vehicle 20*a* to turn in a forwardly or rearwardly leftward arc depending on whether LDR 24 or 26 is illuminated. In similar manner, button 162 has a shank which extends through an opening in the housing wall of illuminator 152 and is affixed to a plate 162*c* having opening which receives shank 154*a* and an opening which receives shank 158*a*. Plate 162*c* bears against ridge 154*d* and a ridge on button 156 so that when button 162 is depressed, both buttons 154 and 156 will be depressed to cause vehicle 20*a* to move in a forwardly or rearwardly rightward arc. In similar manner, depression of button 166 will simultaneously depress buttons 158 and 160 causing vehicle 20*a* to move in a rearwardly or forwardly leftward arc. Button 168 will depress only buttons 154 and 160, button 162 will depress only buttons 154 and 156, button 164 will depress only buttons 156 and 158, and button 166 will depress only buttons 158 and 160. Also, with arrangement in FIGS. 8 and 9, each button 154, 156, 158, and 160 may be individually depressed without affecting the other buttons.

Figure 10:
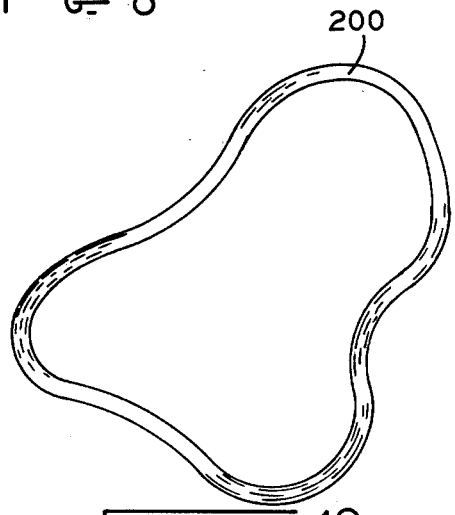
FIG. 10 is a plan view of a track useful with this invention.

Referring to FIG. 10, a track 200 is shown which is proportioned in width and configuration to accommodate a number of vehicles and provide adequate racing clearances. Track 200 may be banked and have configurations resembling famous tracks such as at Daytona or other speedways. Due to the maneuverability and control of the devices of this invention, such a track may be raced by a number of vehicles 20 having the same or different frequency ranges. By providing a number of illuminators 100 with different mutually exclusive frequency ranges of radiation beams 107 used for controlling corresponding vehicles 20 in any one race, and by providing each vehicle 20 with LDR filters which will pass only the frequency range of its respective beam 107, interference from the illuminators of other car operators is minimized. Also, beam 107 may be infrared or ultraviolet with corresponding LDR filters.

Block 50 may be provided with a slip clutch, which is commercially available and well known in the art, in place of switch arms 82 and 84 to slip the drive between shaft 48 and block 50 when the maximum steering angles have been achieved.

Following are component values and identification for a preferred embodiment of this invention:

| | |
|---|---|
| Resistors | |
| Reference Numeral | Component Value |
| 122, 128, 142, 146 | 4.7K Ohms |
| 126 | 100K Ohms |
| 124, 132 | 750 Ohms |
| 147, 149 | 22 Ohms |
| LDRs | |
| Reference Numeral | Component Value |
| 120, 130 | CL904L461 Allen Bradley |
| Motors | |
| Reference Numeral | Component Value |
| 34, 36 | 1.5 Volt d.c. |
| Transistors | |
| Reference Numeral | Component Value |
| 134 | 610142-4 |
| 136 | 610134-P1 |
| 140 | T1P32C |
| 144 | 610131N2 |

It is to be understood that the circuitry of this invention may be incorporated on a printed circuit board or in an integrated circuit, according to practices well known in the art. Also, rechargeable batteries may be used. Further, the LDRs may be recessed to minimize the affect of incident light. Still further, the above description assumes in all instances that proper wiring connections and winding directions are correct to obtain the purpose desired, as is well understood in the art.

While there have been described above the principles of this invention in connection with specific apparatus, it is to be clearly understood that this description is made only by way of example and not as a limitation to the scope of the invention.

What is claimed is:

1. A remote controllable vehicle apparatus comprising:

a vehicle body having a self-contained power supply mounted therein;

first, second, third, and fourth light responsive members mounted on said body and spaced from one another to be selectively illuminated;

first motor means coupled to said power supply in motor driving power receiving relation for providing a rotative drive in first and second rotative directions;

steering means being mounted to said vehicle body for steering said vehicle body in rightward and leftward directions;

said first motor means being drive-coupled to said steering means to steer said vehicle body in a rightward direction upon a first rotative drive direction and in a leftward direction upon a second rotative drive direction;

a manually pointable light source for selectively illuminating said members;

said first and second light responsive members being coupled to said first motor means and said power supply to couple said first motor means to said power supply to provide a rotative drive in said first direction when said first member is illuminated by said light source and to provide a rotative drive in said second direction when said second member is illuminated by said light source;

a second motor means coupled to said power supply in motor driving power receiving relation for providing a rotative drive in first and second rotative directions;

propelling means being mounted to the vehicle body for propelling said vehicle body in forward and reverse directions;

said second motor means being drive-coupled to said propelling means to propel said vehicle body in a forward direction upon a first rotative drive direction of said second motor means and in a rearward direction upon a second rotative drive direction of said second motor means;

said third and fourth light responsive members being coupled to said second motor means and said power supply to couple said second motor means to said power supply to provide a rotative drive in said first direction of said second motor means when said third member is illuminated by said light source and to provide a rotative drive in said second direction of said second motor means when said fourth member is illuminated by said light source.

2. The apparatus of claim 1 wherein said first motor means has a first winding and said second motor means has a second winding;

circuit means for coupling said first and second light responsive members to said first winding and said power supply to generate current in one direction through said first winding upon light incidence on said first light responsive member to steer said vehicle body rightwardly and for coupling said second light responsive member to said first winding and said power supply to generate current in said first winding in the direction opposite to said one direction upon light incidence on said second light responsive member to steer said vehicle body leftwardly;

circuit means for coupling said third and fourth light responsive members to said second winding and said power supply to generate current in one direction through said second winding upon light incidence on said third light responsive member to propel said vehicle body forwardly and to generate current in the opposite direction upon light incidence on said fourth light responsive member to propel said vehicle body rearwardly.

3. The apparatus of claim 1 including filter means for said first, second, third, and fourth light responsive members for providing mutually exclusive light energy frequency responsive member ranges to at least two of said members;

said light source having filter means for filtering the light energy frequency of said source to provide source ranges corresponding to said at least two member ranges whereby said at least two members can be energized mutually exclusively from said source.

4. The apparatus of claim 3 wherein said member ranges and corresponding source frequency ranges correspond to the colors red, green, and blue.

5. The apparatus of claim 1 including a plurality of remote controllable vehicle apparatuses;

first filter means for passing a first range of light energy frequencies for the first, second, third, and fourth light responsive members of a first apparatus;

second filter means for passing a second range of light energy frequencies for the first, second, third, and fourth light responsive members of a second apparatus;

the light energy frequencies in said first and second ranges being mutually exclusive;

a plurality of manually pointable light sources;

third filter means for filtering the light energy from a first of said sources to pass said first range of frequencies and not said second range of frequencies;

fourth filter means for filtering the light energy from a second of said sources to pass said second range of frequencies and not said first range of frequencies; whereby said first apparatus is responsively controllable by said first light source and not said second light source and said second apparatus is responsively controllable by said second light source and not said first light source.

6. A remote controlled vehicle apparatus comprising:

a vehicle body having a power supply mounted therein;

a plurality of light responsive members being mounted on said body in spaced relation from one another;

drive means mounted in said vehicle body and coupled to said power supply in drive receiving power relation for maneuvering said vehicle body; said drive means being operable in first and second directions;

a manually pointable light beam source having a beam definition sufficiently narrow to selectively illuminate said members;

circuit means for coupling said members to said drive means to selectively couple said drive means and said power supply to maneuver said body in correspondence with selective illumination of said members by said source;

said circuit means comprising switch means for selectively coupling said drive means to said power supply, said switch means having first and second switches being coupled to and switchably responsive to illumination of said members whereby during periods of unequal illumination of said members by said manually pointable light beam source only one of said switches is closed to couple said drive means to said power supply to maneuver said body in a direction corresponding to said unequal illumination and during periods of equal illumination of said members both of said switches are open to decouple said drive means from said power supply so that ambient light effect is minimized, said drive means being directly coupled to the switch output from either of said switches.

7. The apparatus of claim 6 wherein said circuit means comprises:

two of said light responsive members being coupled in series and connected at a junction;

said power supply comprising battery means being coupled in parallel across said two members;

said switch means comprising an NPN transistor having a base, collector, and emitter being connected in series with a PNP transistor having a base collector and emitter, the emitters of said transistors being coupled at a grounded terminal and the collectors of said transistors being coupled to opposite poles of said battery means;

said junction being coupled to the bases of said transistors whereby upon equal illumination of said two members neither transistor will conduct and upon one member being illuminated greater than the other member, one of said transistors will conduct, and the other of said transistors will conduct when the other member is illuminated greater than said one member;

said transistors being coupled to said drive means for energizing said drive means in one direction upon conduction of one of said transistors and energizing said drive means in the other direction upon conduction of the other of said transistors.

8. The apparatus of claim 7 including:

a first conductive resilient arm being coupled to the emitter of one transistor and resiliently engageable with said ground terminal;

a second conductive resilient arm being coupled to the emitter of the other of said transistor and resiliently engageable with said ground terminal;

steering limit means for resiliently displacing said first arm to disconnect said first arm from said ground terminal to limit steering movement in a rightward direction and for resiliently displacing said second arm from said ground terminal to limit steering movement in a leftward direction.

9. Remote controlled vehicle apparatus comprising:

a vehicle body;

first means mounted in said body and responsive to light energy for causing said body to turn in a rightward direction and for causing said body to turn in a leftward direction;

second means mounted in said body and responsive to light energy for propelling said body in a forward direction and for propelling said body in a reverse direction;

at least one wheel mounted to the underside of said body for rotation about the wheel axis for movably supporting said body on a supporting surface: said wheel being mounted to the underside of said body for turning about a vertical axis to steer said body;

said first means comprising a first motor coupled to said wheel to turn said wheel about said vertical axis to cause said body to be steered in one of a right and left direction;

a second wheel spaced from said one wheel and mounted to the underside of said body for rotation about the axis of said second wheel; said second means comprising a second motor to rotate said second wheel about its axis to propel said body in one of a forward and reverse direction;

said first motor having a motor winding for rotating a motor shaft in a direction depending on current direction through said winding;

a first light responsive member;

a second light responsive member;

circuit means for coupling said first light responsive member to said winding to generate current in one direction through said winding upon light incidence on said first light responsive member and for coupling said second light responsive member to said winding to generate current in the direction opposite to said one direction upon light incidence on said second light responsive member, whereby incident light on said first light responsive member will cause said motor shaft to turn said one wheel in a rightward direction and incident light on said second light responsive member will cause said one wheel to turn in a leftward direction;

said circuit means comprising first, second, third and fourth transistors each having a base, collector and emitter; a power source having positive and negative voltage outputs; said first light responsive member being coupled between said positive voltage output and the base of said first transistor; the collector of said first transistor being resistively coupled to said positive voltage output and the base of said second transistor; said second light responsive member being coupled between said negative voltage output and the base of said third transistor; the collector of said third transistor being resistively coupled between said negative voltage output and the base of said fourth transistor; one terminal of said winding being coupled to the collectors of said second and fourth transistors; and the other terminal of said winding being coupled to a potential intermediate of said positive and negative voltage outputs; the emitters of said first and third transistors being coupled to said intermediate potential; the bases of said first and third transistors being resistively coupled to said intermediate potential.

10. The apparatus of claim 9 including a first switch between the emitter of said first transistor and said intermediate potential; and a second switch between the emitter of said third transistor and said intermediate potential means for opening said first switch when said wheel has been turned about said vertical axis a predetermined angle in one direction and for opening said second switch when said wheel has been turned a predetermined angle about said vertical axis in the opposite direction.

* * * * *